US007865115B2

(12) United States Patent
Oguma et al.

(10) Patent No.: US 7,865,115 B2
(45) Date of Patent: Jan. 4, 2011

(54) PROCESS CARTRIDGE, ELECTROPHOTOGRAPHIC IMAGE FORMING APPARATUS, METHOD OF MANUFACTURING A PROCESS CARTRIDGE, AND METHOD OF REMANUFACTURING A PROCESS CARTRIDGE

(75) Inventors: Toru Oguma, Mishima (JP); Shinichi Nishida, Mishima (JP); Fumito Nonaka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 1049 days.

(21) Appl. No.: 11/613,521

(22) Filed: Dec. 20, 2006

(65) Prior Publication Data

US 2007/0248382 A1 Oct. 25, 2007

(30) Foreign Application Priority Data

Apr. 19, 2006 (JP) ..... 2006-115169

(51) Int. Cl.
*G03G 15/00* (2006.01)

(52) U.S. Cl. ..... 399/167; 399/168

(58) Field of Classification Search ..... 399/113, 399/115, 167–168
See application file for complete search history.

(56) References Cited

U.S. PATENT DOCUMENTS

| | | | | |
|---|---|---|---|---|
| 5,596,395 | A * | 1/1997 | Sawamura et al. | 399/168 |
| 5,666,608 | A * | 9/1997 | Christensen | 399/176 |
| 5,768,658 | A | 6/1998 | Watanabe et al. | 399/111 |
| 6,097,909 | A | 8/2000 | Watanabe et al. | 399/111 |
| 6,101,348 | A | 8/2000 | Nonaka et al. | 399/103 |
| 6,266,500 | B1 | 7/2001 | Numagami et al. | 399/104 |
| 6,272,299 | B1 | 8/2001 | Numagami et al. | 399/111 |
| 6,377,759 | B1 | 4/2002 | Abe et al. | 399/27 |
| 6,385,420 | B1 * | 5/2002 | Morioka | 399/174 |
| 6,512,895 | B2 | 1/2003 | Sakurai et al. | 399/13 |
| 6,519,430 | B2 * | 2/2003 | Higeta et al. | 399/109 |
| 6,571,070 | B2 | 5/2003 | Oguma et al. | 399/27 |
| 6,587,650 | B2 | 7/2003 | Yokoi et al. | 399/27 |
| 6,594,454 | B2 | 7/2003 | Oguma et al. | 399/90 |
| 6,625,413 | B2 | 9/2003 | Oguma et al. | 399/222 |
| 6,658,224 | B2 | 12/2003 | Yokoi et al. | 399/113 |

(Continued)

FOREIGN PATENT DOCUMENTS

| | | |
|---|---|---|
| JP | 07-160095 | 6/1995 |

(Continued)

*Primary Examiner*—David M Gray
*Assistant Examiner*—Geoffrey T Evans
(74) *Attorney, Agent, or Firm*—Fitzpatrick, Cella, Harper & Scinto

(57) ABSTRACT

A process cartridge has an electrophotographic photosensitive drum, a charging roller for charging the drum, a spacer movable between a separation position for separating the roller from the drum and a contact position for contacting the roller to the drum, a rotatable receiving gear for receiving a driving force produced by rotation of the drum to move the spacer from the separation position to the contact position, and a rotatable transmission gear engaged with the receiving gear and the spacer to transmit the force from the receiving gear to the spacer to move the spacer from the separation position to the contact position, wherein play is provide in the engagement portion between the receiving gear and the transmission gear so that they can be freely rotated relative to each other by a predetermined angle, whereby the drum is not reversely rotated when the roller is separated from the drum.

11 Claims, 12 Drawing Sheets

U.S. PATENT DOCUMENTS

| | | | | |
|---|---|---|---|---|
| 6,671,477 | B2 | 12/2003 | Komatsu et al. | 399/113 |
| 6,684,040 | B2 | 1/2004 | Yokoi et al. | 399/119 |
| 6,704,525 | B2 | 3/2004 | Oguma et al. | 399/27 |
| 6,804,475 | B2 | 10/2004 | Oguma et al. | 399/27 |
| 6,804,483 | B2 | 10/2004 | Yokoi et al. | 399/113 |
| 6,826,380 | B2 | 11/2004 | Karakama et al. | 399/111 |
| 6,832,057 | B2 | 12/2004 | Oguma et al. | 399/27 |
| 6,859,627 | B2 | 2/2005 | Karakama et al. | 399/27 |
| 6,868,243 | B2 | 3/2005 | Watanabe et al. | 399/113 |
| 6,882,813 | B2 | 4/2005 | Lee | 399/126 |
| 6,892,035 | B2 | 5/2005 | Matsumoto et al. | 399/27 |
| 6,922,534 | B2 | 7/2005 | Goto et al. | 399/12 |
| 6,993,264 | B2 | 1/2006 | Oguma et al. | 399/90 |
| 7,024,131 | B2 | 4/2006 | Komatsu et al. | 399/109 |
| 7,062,192 | B2 | 6/2006 | Oguma et al. | 399/90 |
| 7,082,276 | B2 | 7/2006 | Karakama et al. | 399/111 |
| 7,095,967 | B2 | 8/2006 | Karakama et al. | 399/27 |
| 7,162,176 | B2 | 1/2007 | Oguma et al. | 399/90 |
| 7,231,161 | B2 * | 6/2007 | Noda et al. | 399/90 |
| 7,239,823 | B2 | 7/2007 | Oguma et al. | 399/90 |
| 7,570,901 | B2 * | 8/2009 | Choi | 399/126 |
| 7,680,429 | B2 * | 3/2010 | Takaya et al. | 399/100 |
| 2004/0086300 | A1 * | 5/2004 | Kawai et al. | 399/167 |
| 2005/0191081 | A1 * | 9/2005 | Muraishi et al. | 399/100 |
| 2007/0092285 | A1 | 4/2007 | Oguma et al. | 399/90 |

FOREIGN PATENT DOCUMENTS

| | | |
|---|---|---|
| JP | 11-024452 | 1/1999 |
| JP | 11-095532 | 4/1999 |
| JP | 2000-320537 | 11/2000 |
| JP | 2001-013762 | 1/2001 |
| JP | 2002-311690 | 10/2002 |
| JP | 2003-076117 | 3/2003 |
| JP | 2004-163708 | 6/2004 |

* cited by examiner

PROCESS CARTRIDGE, ELECTROPHOTOGRAPHIC IMAGE FORMING APPARATUS, METHOD OF MANUFACTURING A PROCESS CARTRIDGE, AND METHOD OF REMANUFACTURING A PROCESS CARTRIDGE

BACKGROUND OF THE INVENTION

1. Field of the Invention

The present invention relates to a process cartridge and an electrophotographic image forming apparatus using the same, and further to a method of manufacturing the process cartridge and a method of remanufacturing the process cartridge.

Here, the electrophotographic image forming apparatus forms an image on a recording medium by the use of an electrophotographic image forming process, and this term includes, for example, an electrophotographic copying machine, an electrophotographic printer (such as, for example, an LED printer or a laser beam printer), an electrophotographic facsimile apparatus and an electrophotographic word processor or the like.

Also, the process cartridge refers to an electrophotographic photosensitive member and at least a charging roller for acting thereon integrally made into a cartridge detachably mountable to the main body of the electrophotographic image forming apparatus.

2. Description of the Related Art

Heretofore, in an image forming apparatus for forming an image on a recording medium by the use of an electrophotographic image forming process, or a process cartridge detachably mountable to the main body of the image forming apparatus, use has been widely made of a method of bringing a charging roller as means for charging an electrophotographic photosensitive member (photosensitive drum) and rotating it. In such a contact charging roller method, an electrically conductive elastic roller is brought into pressure contact with the photosensitive drum, and a voltage is applied thereto to thereby effect the charging of the photosensitive drum by discharge.

In this charging roller method, there is known a construction provided with a mechanism for separating the charging roller and the photosensitive drum from each other and releasing the separation in order to eliminate a state in which the charging roller is left in pressure contact with the photosensitive drum for a long period of time (Japanese Patent Application Laid-Open No. 2002-311690).

The above-described conventional charging roller separating construction uses a spacer for separating the charging roller from the photosensitive drum, and when the photosensitive drum is rotated, the spacer is rotated to thereby release the separated state.

The spacer is moved by a gear provided on the photosensitive drum and therefore, it is necessary to reversely rotate the photosensitive drum when the charging roller is to be separated.

SUMMARY OF THE INVENTION

It is an object of the present invention to provide a process cartridge and an electrophotographic image forming apparatus in which an electrophotographic photosensitive drum is not reversely rotated when a charging roller is separated from the electrophotographic photosensitive member, and a method of manufacturing the process cartridge and a method of remanufacturing the process cartridge.

It is another object of the present invention to provide a process cartridge detachably mountable to the main body of an electrophotographic image forming apparatus for forming an image on a recording medium, and having a rotatable electrophotographic photosensitive member, a charging roller for contacting the electrophotographic photosensitive member to charge the electrophotographic photosensitive member, a separation member for separating the electrophotographic photosensitive member and the charging roller from each other, and movable between a separation position for separating the electrophotographic photosensitive member and the charging roller from each other and a contact position for bringing the electrophotographic photosensitive member and the charging roller into contact with each other, a rotatable driving force receiving member for receiving a driving force produced by the electrophotographic photosensitive member being rotated, and a rotatable driving force transmission member engaged with the driving force receiving member and the separation member to transmit the driving force from the driving force receiving member to the separation member in order to move the separation member from the separation position to the contact position, wherein play is provided in the engagement portion between the driving force receiving member and the driving force transmission member so that they can be freely rotated relative to each other by a predetermined angle.

Further features of the present invention will become apparent from the following description of exemplary embodiments with reference to the accompanying drawings.

DESCRIPTION OF THE EMBODIMENTS

First Embodiment

A process cartridge according to an embodiment of the present invention and an electrophotographic image forming apparatus using the same will now be described with reference to the drawings.

[Description of the Entire Image Forming Apparatus]

Figure 9:
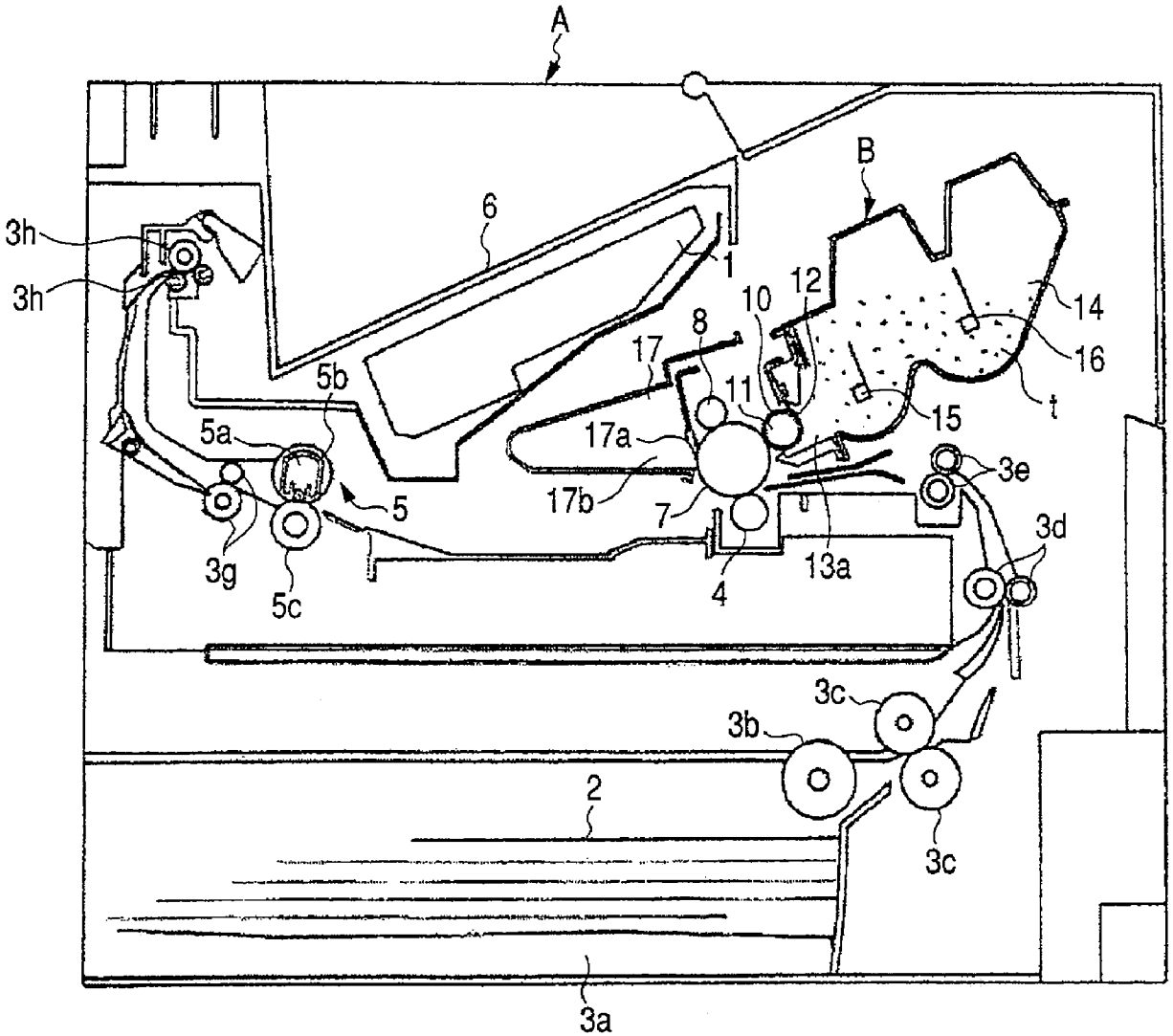
FIG. 9 is an illustration showing the general construction of an image forming apparatus.

Reference is first had to FIG. 9 to describe an image forming apparatus to which a process cartridge constructed on the basis of the present embodiment is detachably mounted. FIG. 9 schematically shows the construction of an electrophotographic image forming apparatus according to a first embodiment.

The image forming apparatus according to the present embodiment has a drum-shaped electrophotographic photosensitive member (hereinafter referred to as the "photosensitive drum") 7. The photosensitive drum 7 is charged by a charging roller 8 as a charging member. Then, a laser beam according to image information is applied from optical means 1 to the photosensitive drum 7, whereby a latent image according to the image information is formed thereon. This latent image is developed into a visible image, i.e., a toner image, by developing means by the use of a toner "t".

On the other hand, in synchronism with the formation of the toner image, a recording medium 2 set on a feeding cassette 3*a* is conveyed to a transfer position by a pickup roller 3*b* and pairs of conveying rollers 3*c*, 3*d* and 3*e*. A transfer roller 4 as transferring means is disposed in the transfer position. A transfer bias is applied to the transfer roller 4, whereby the toner image on the photosensitive drum 7 is transferred to the recording medium 2.

The recording medium 2 having received the transfer of the toner image is conveyed to fixing means 5. The fixing means 5 is provided with a drive roller 5*c* and a fixing roller 5*b* containing a heater 5*a* therein. The fixing means 5 applies heat and pressure to the passing recording medium 2 to thereby fix the transferred toner image on the recording medium 2. Thereafter, the recording medium 2 is conveyed by pairs of discharge rollers 3*g* and 3*h* and is discharged onto a discharge tray 6. The pickup roller 3*b*, the pairs of conveying rollers 3*c*, 3*d*, 3*e* and the pairs of discharge rollers 3*g*, 3*h* together constitute conveying means for the recording medium 2.

[Description of the Process Cartridge]

Figure 10:
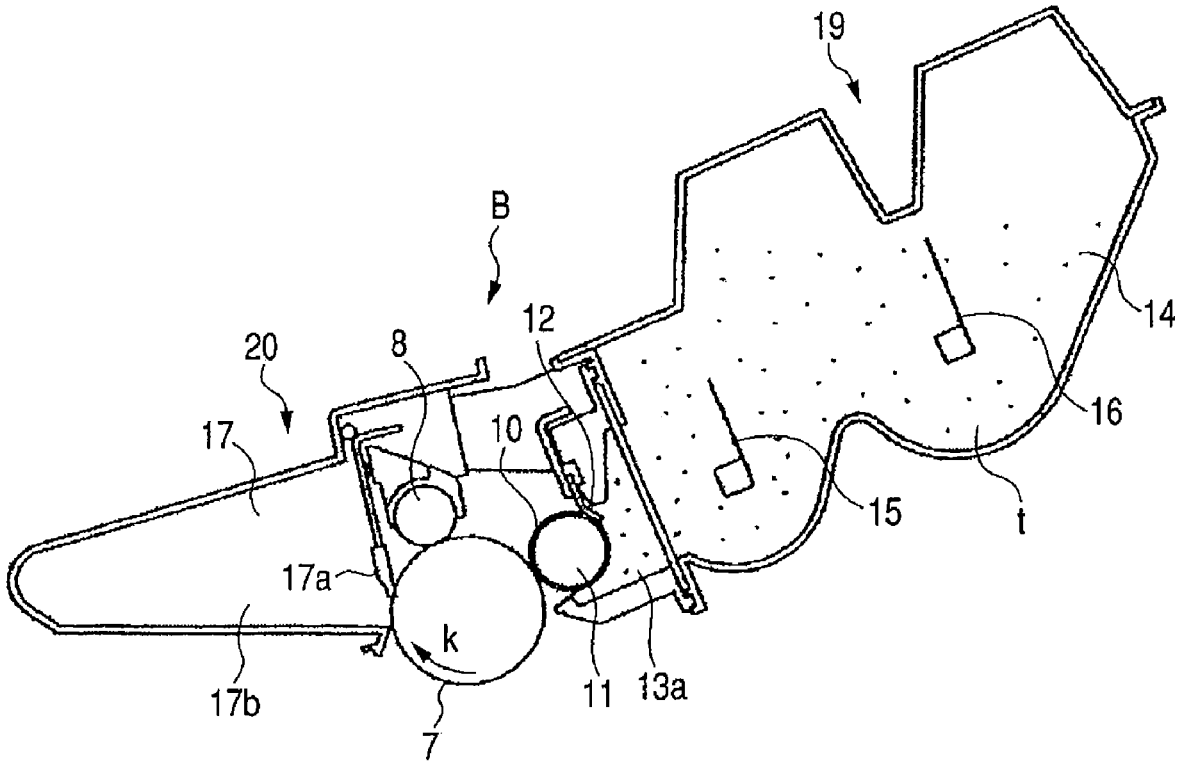
FIG. 10 is a cross-sectional illustration of a cartridge.

FIG. 10 is a cross-sectional view of the process cartridge B detachably mountable to the main body of the electrophotographic image forming apparatus (hereinafter referred to the "main body") A according to the first embodiment. As shown in FIG. 10, the process cartridge (hereinafter referred to as the "cartridge") B has the photosensitive drum 7, and the charging roller 8 for contacting with at least the photosensitive drum 7 to thereby charge the electrophotographic photosensitive member. The cartridge B according to the present embodiment further has developing means for toner-developing the latent image formed on the photosensitive drum 7, and cleaning means 17 for removing any toner residual on the photosensitive drum 7.

A drum unit 20 provided with the photosensitive drum 7, the charging roller 8, the cleaning means 17, etc. and a developing unit 19 provided with a developing roller 10, a developing blade 12, toner conveying members 15, 16, etc. as the developing means are integrally made into a cartridge. This cartridge B is detachably mountable to the main body A.

The developing means conveys the toner "t" in a toner container 14 to the developing chamber 13*a* of a developing frame 13 by the rotation of the toner conveying members 15 and 16. The developing means rotates a developing roller 10 containing a magnet roller 11 therein and also, forms on the surface of the developing roller 10 a toner layer to which triboelectrification charges have been imparted by the developing blade 12. Then, the toner is shifted to the photosensitive drum 7 in accordance with the latent image to thereby form a visible toner image. A toner seal (not shown) for sealing the toner "t" in the toner container 14 is provided between the toner container 14 and the developing frame 13. Before using the apparatus, an operator removes this toner seal from between the toner container 14 and the developing frame 13, whereby the toner "t" becomes capable of being conveyed to the developing chamber 13*a*.

The developing blade 12 serves to prescribe the amount of toner on the peripheral surface of the developing roller 10 and impart the triboelectrification charges.

The photosensitive drum 7 after the toner image has been transferred to the recording medium 2 by the transfer roller 4 has any toner residual thereon removed by the cleaning means 17, and thereafter is used for the next image forming process. The cleaning means 17 scrapes off the residual toner on the photosensitive drum 7 by an elastic cleaning blade 17*a* provided in abutting relationship with the photosensitive drum 7 and collects the toner into a toner reservoir 17*b*.

[Separating Construction for the Charging Roller]

The cartridge B according to the present embodiment is designed such that during the shipping or the like of the product, the charging roller 8 can be separated from the photosensitive drum 7. The separating construction for the charging roller 8 will now be described.

Figure 11:
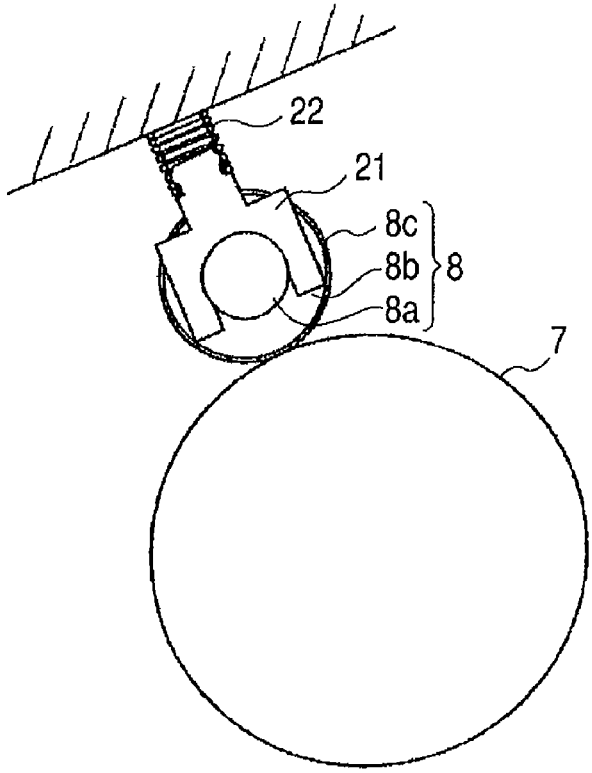
FIG. 11 is an illustration of a charging roller.

The charging roller 8 in the present embodiment, as shown in FIG. 11, is comprised of a metal shaft 8*a*, a base layer 8*b* formed of a sponge material, and a surface high resistance layer 8*c*. The lengthwise opposite ends of the metal shaft 8*a* are rotatably supported by bearings 21, and the charging roller 8 is brought into pressure contact with the photosensitive drum 7 by a pressure spring 22. The pressure force of the pressure spring 22 in the present embodiment is adjusted so as to be about 500 gf on one side thereof.

Figure 12:
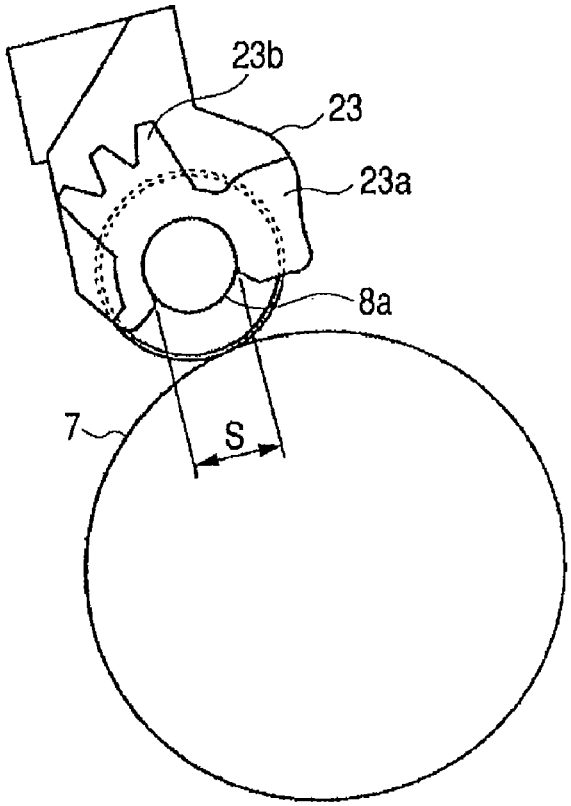
FIG. 12 is an illustration of the spacer.
Figure 13:
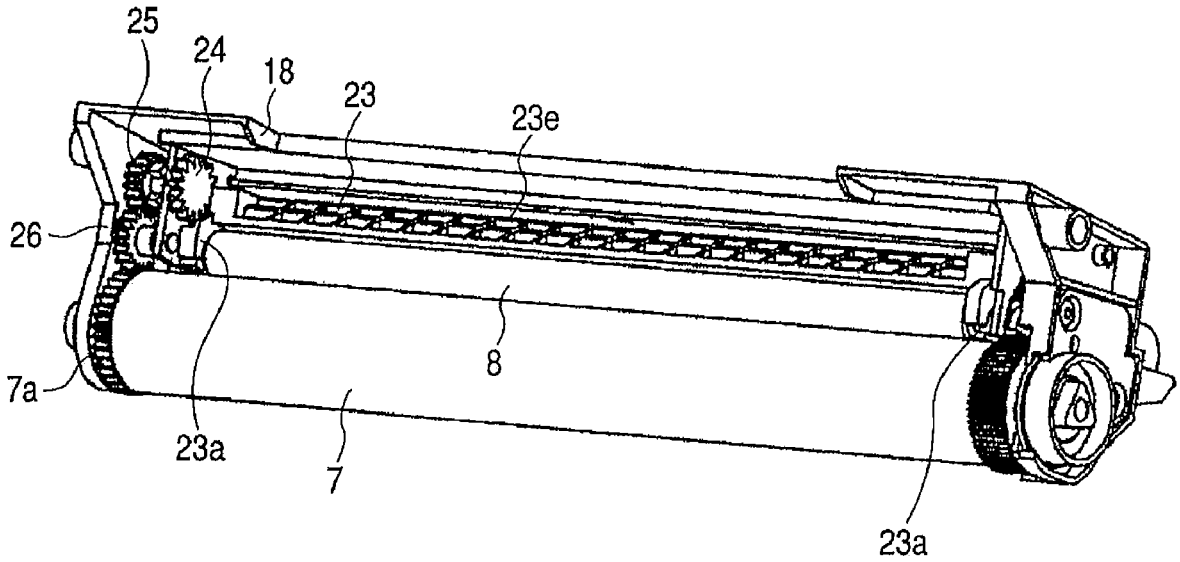
FIG. 13 is a perspective illustration of a drum unit.

As shown in FIGS. 12 and 13, a spacer 23 as a separation member for separating the charging roller 8 from the photosensitive drum 7 is rotatably mounted on the metal shaft 8*a* at the opposite ends of the charging roller 8. This spacer 23 is movable between a separating position for separating the photosensitive drum 7 and the charging roller 8 from each other and a contact position for bringing the photosensitive drum 7 and the charging roller 8 into contact with each other.

[Spacer]

The spacer 23 is integrally formed into a shape having cam portions 23*a* disposed at the lengthwise opposite ends of the charging roller 8, and a connecting portion 23*e* connecting these cam portions together. Also, the mounted portion of the spacer 23 with respect to the metal shaft 8*a* is of a U-shape in which the width S of the entrance is somewhat smaller than the diameter of the metal shaft 8*a*, and is mounted on the metal shaft 8*a* by snap fit.

Figure 1A:
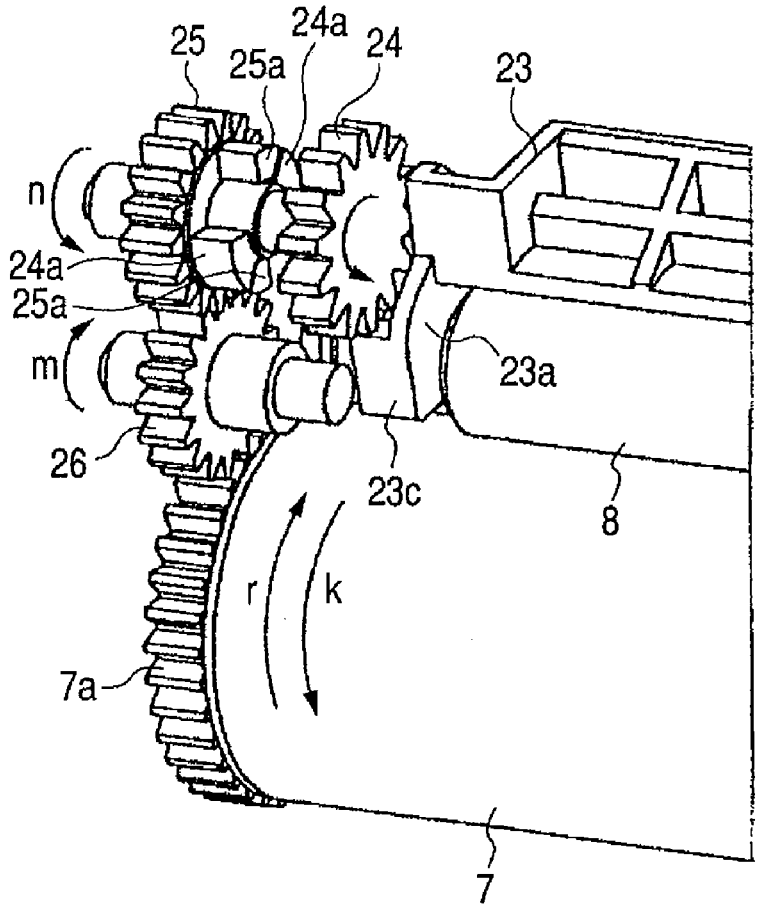
FIGS. 1A and 1B are illustrations of a drive transmitting construction to a spacer.
Figure 1B:
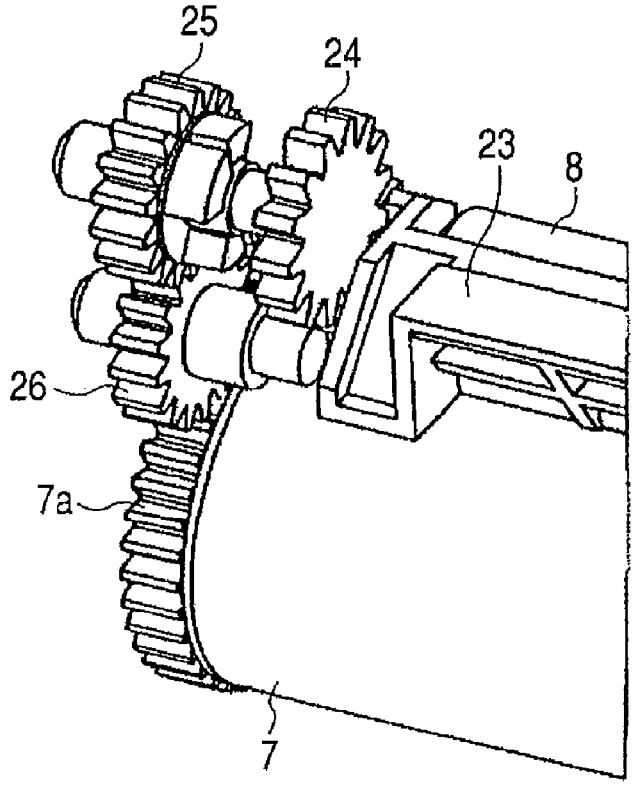
Figure 2A:
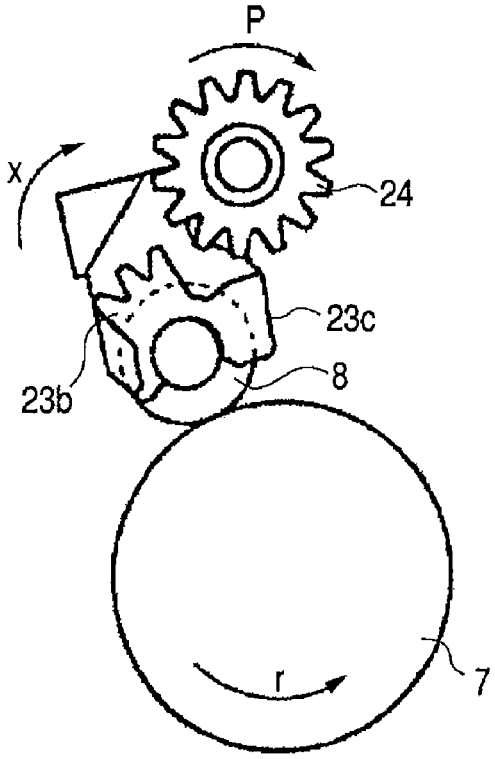
FIGS. 2A and 2B are illustrations showing the operation of the spacer.
Figure 2B:
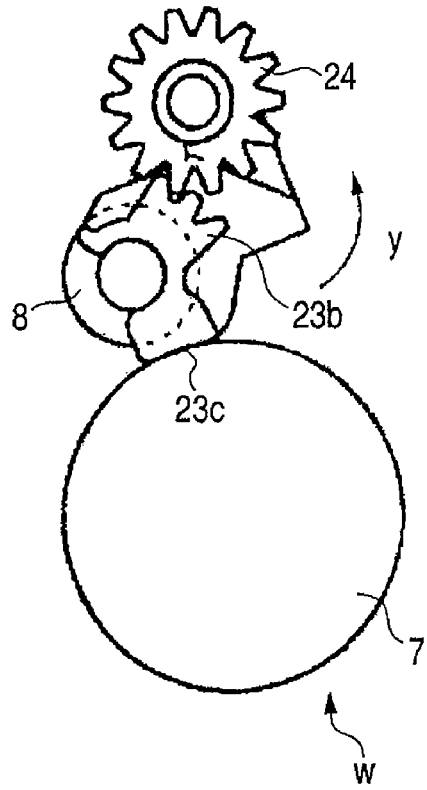

Here, the spacer 23 will be described in greater detail with reference to FIGS. 1A, 1B, 2A and 2B. FIGS. 1A and 2A show a state in which the charging roller 8 and the photosensitive drum 7 are in contact with each other, and FIGS. 1B and 2B show a state in which the charging roller 8 is separated from the photosensitive drum 7 by the spacer 23.

During the shipment, the cartridge B according to the present embodiment is in a state in which the charging roller 8 is separated from the photosensitive drum 7. It is of a construction in which during the first use of the cartridge B, the space 23 is rotated in operative association with the rotation of the photosensitive drum 7 and the separated state is released.

The spacer 23 is provided with a spacer gear 23*b* constituted on the cam portion 23*a* by a partial gear, and an arcuate portion 23*c* abutting against the photosensitive drum 7. The cam portion 23*a* receives a rotating force from the spacer gear 23*b* and is rotated thereby, and as shown in FIG. 2B, the arcuate portion 23*c* abuts against the photosensitive drum 7. As the result, the charging roller 8 is separated from the photosensitive drum 7 by about 1.5 mm.

The spacer 23 is rotated by the rotation of the photosensitive drum 7. For example, the cartridge B when unused is such that as previously described, the arcuate portion 23*c* of the spacer 23 abuts against the photosensitive drum 7 and the charging roller 8 is separated from the photosensitive drum 7. During the use of this cartridge B, the photosensitive drum 7 is forwardly rotated in the direction indicated by the arrow "k" in FIG. 1A (the same direction as the rotation direction during image formation).

An idler gear 26 meshing with a drum gear 7*a* receives a driving force from the drum gear 7*a* mounted on lengthwise one end portion of the photosensitive drum 7 and is rotated in the direction indicated by the arrow "m" thereby. Thereby, a receiving gear 25 as a driving force receiving member meshing with the idler gear 26 is rotated in the direction indicated by the arrow "n". This receiving gear 25 receives the driving force produced by the photosensitive drum 7 being rotated, in order to move the spacer 23 from a separated position to a contact position.

A transmission gear 24 as a driving force transmission member for receiving the driving force from the receiving gear 25 and transmitting the driving force to the spacer 23 receives the driving force from the receiving gear 25 and is rotated in the direction indicated by the arrow "p" thereby. The spacer gear 23*b* meshing with this transmission gear 24 is then rotated in the direction indicated by the arrow "y" in FIG. 2B. Thereby, the separated state of the charging roller 8 from the photosensitive drum 7 is released.

At this time, the spacer gear 23*b* and the transmission gear 24 are adapted to be released from meshing engagement, and the center of gravity of the spacer 23 is set so that thereafter the spacer may be rotated in the direction indicated by the arrow "y" by the gravity of the spacer 23. When the spacer 23 is rotated and the charging roller 8 contacts the photosensitive drum 7, the spacer 23 is not engaged with the gear train. As the result, even if the photosensitive drum 7 is rotated, the rotating force is not transmitted to the spacer 23.

As described above, the rotative driving force is transmitted to the spacer gear 23*b* from the drum gear 7*a* through the idler gear 26, the receiving gear 25 and the transmission gear 24. The gears 26, 25 and 24 are mounted on a drum frame 18 (see FIG. 13) which is the frame of the drum unit 20.

The spacer 23 has its two cam portions 23*a* connected together by a connecting portion 23*e*. Therefore, simply to the cam portion 23*a* on one side, the separation of the charging roller can be released.

[The Play of the Drive Transmission to the Spacer and Cartridge Manufacturing Steps and Remanufacturing Steps]

The cartridge B is provided with a play in engagement portion between the receiving gear 25 and the transmission gear 24 so that these gears can be freely rotated relative to each other by a predetermined angle. By this play, no load is adapted to be applied to the photosensitive drum 7 at the assembling step of rotating the spacer 23 to thereby separate the charging roller 8 from the photosensitive drum 7. This construction will now be described.

Figure 3:
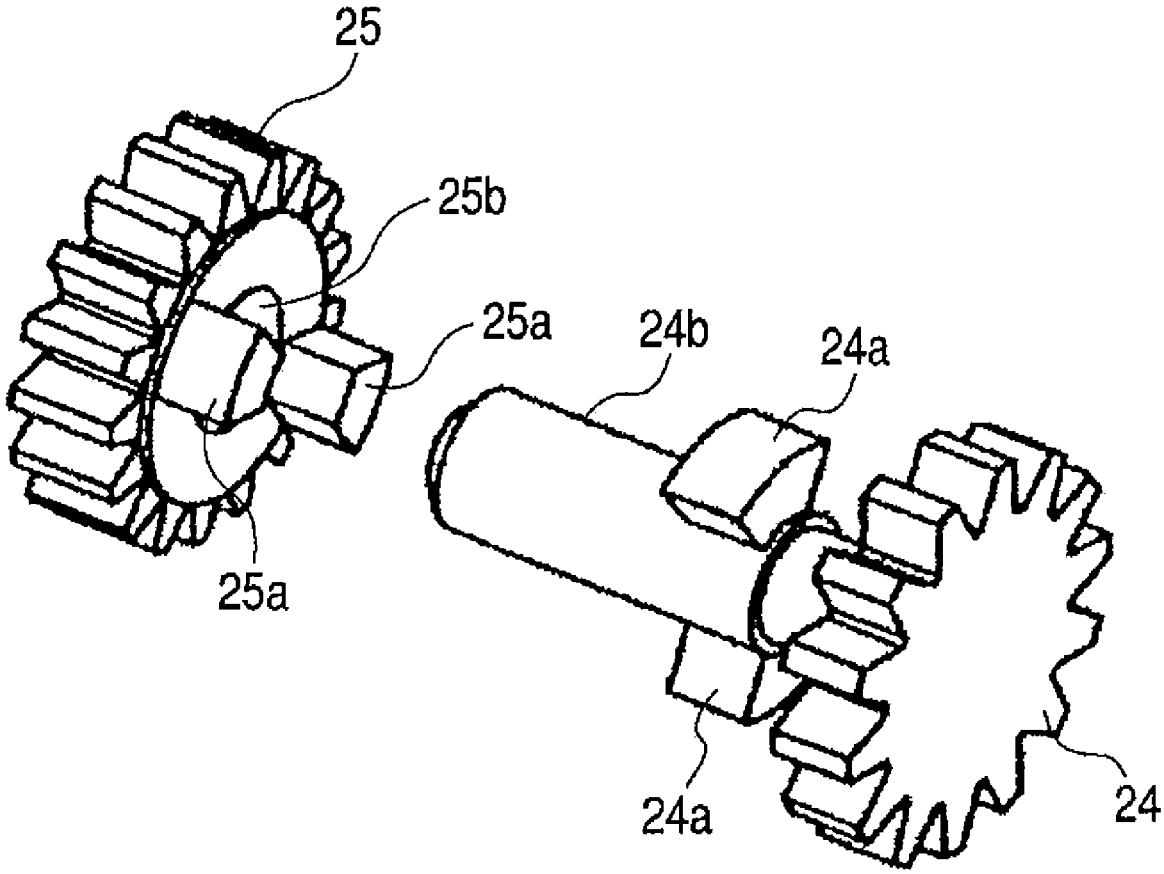
FIG. 3 is a perspective illustration of a gear having a coupling portion.

As shown in FIGS. 1A, 1B and 3, the transmission gear 24 and the receiving gear 25 are provided coaxially with each other. A coupling portion (first protrusion) 24*a* provided on the transmission gear 24 and a coupling portion (second protrusion) 25*a* provided on the receiving gear 25 are engaged with each other, whereby the rotative driving force is transmitted. That is, the engagement portion between the receiving gear 25 and the transmission gear 24 is constituted by a coupling connecting portion.

The connecting portion between the coupling portions 24*a* and 25*a* in the present embodiment is of a shape having a play of a predetermined angle (about 90° in the present embodiment) in the rotation direction, and this range is such that the driving force is not transmitted, but they can be freely rotated relative to each other. In the present embodiment, these gears 24, 25 and 26 together constitute moving means for the spacer 23. Also, as shown in FIG. 3, a through-aperture 25*b* for extending the shaft portion 24*b* of the transmission gear 24 therethrough is formed at the center of rotation of the receiving gear 25.

It the inspecting step when the cartridge B is assembled, the cartridge B is sometimes operated, that is the photosensitive drum 7 is sometimes rotated as during image formation. In the construction of the present embodiment, if the above-mentioned inspecting step is executed after the charging roller 8 has been separated from the photosensitive drum 7 by the spacer 23, the separated state of the charging roller 8 will be released by the rotation of the photosensitive drum 7 and the charging roller will contact with the photosensitive drum 7. Therefore, it is necessary to separate the charging roller 8 from the photosensitive drum 7 after the inspecting step.

When the charging roller 8 is to be separated from the photosensitive drum 7, the spacer 23 is rotated in the direction indicated by the arrow "x" from the state of FIG. 2A to thereby bring about the state of FIG. 2B. At this time, the spacer gear 23*b* and the transmission gear 24 come into meshing engagement with each other and therefore, the transmission gear 24 is rotated. However, the predetermined angle (about 90° in the present embodiment) providing a play in which the driving force between the transmission gear 24 and the receiving gear 25 is not transmitted is set to an angle greater than the angle by which the transmission gear 24 is rotated at this time (about 60° in the present embodiment). Thereby, the receiving gear 25 can be prevented from being rotated when the charging roller 8 is separated form the photosensitive drum 7.

That is, when the spacer 23 is to be rotated in the direction indicated by the arrow "x", the transmission gear 24 is rotated in advance in the direction indicated by the arrow "p" to thereby bring about a position in which the coupling portion 24*a* of the transmission gear 24 abuts against the coupling portion 25*a* of the receiving gear 25 (the state of FIG. 1A). Thereby, even if the spacer 23 is rotated in the direction indicated by the arrow "x" in FIG. 2A and the spacer gear 23*b* meshes with the transmission gear 24 and the transmission gear 24 is rotated in a direction opposite to the direction indicated by the arrow "p" when the charging roller 8 is separated, the coupling portions 24*a* and 25*a* will not be engaged with each other. Therefore, the driving force is not transmitted from the transmission gear 24 to the receiving gear 25. Therefore, there is not produced a driving force which rotates the photosensitive drum 7 in a reverse direction (the direction indicated by the arrow "r", i.e., a direction opposite to the rotation direction during image formation).

As described above, at the step of separating the charging roller 8, the photosensitive drum 7 is first rotated in the same direction as the direction in which the photosensitive drum 7 is rotated when an image is formed thereon to thereby inspect (the photosensitive member rotating step). Next, the transmission gear 24 is rotated in the same direction as the direction in which transmission gear 24 is rotated when an image is formed, to thereby cause the coupling portion 24*a* to abut against the coupling portion 25*a* of the receiving gear 25 (the transmission gear rotating step). After this state has been brought about, the spacer 23 is moved from the position of FIG. 2A to the position of FIG. 2B to thereby separate the charging roller 8 from the photosensitive drum 7 (the spacer moving step).

Thereby, even if the spacer 23 is rotated to separate the charging roller 8 from the photosensitive drum 7, the photosensitive drum 7 will not be rotated (at this time, the charging roller 8 is not rotated). Accordingly, the spacer 23 can be easily rotated by a small load. Also, the occurrence of memory due to the frictional contact between the photosensitive drum 7 and the charging roller 8 during the contact and separation therebetween can be prevented.

When the cartridge B is to be remanufactured after the cartridge B has been used, another electrophotographic photosensitive member differing from this electrophotographic photosensitive member is mounted after the latter electrophotographic photosensitive member has once been detached (the photosensitive member interchanging step). Thereafter, the aforedescribed photosensitive member rotating step, transmission gear rotating step and spacer moving step are used.

Also, in a construction wherein as in the present embodiment, the cleaning blade 17*b* is caused to abut against the photosensitive drum 7, it is often the case that a lubricant is applied to between the photosensitive drum 7 and the cleaning blade 17*b*. In that case, if the photosensitive drum 7 is reversely rotated when the charging roller 8 is separated, the lubricant may be stripped off and become incapable of sufficiently displaying its performance. In the construction of the present embodiment, however, as described above, the photosensitive drum is not reversely rotated and therefore, the effect of the lubricant can be suppressed from being spoiled.

Figure 4A:
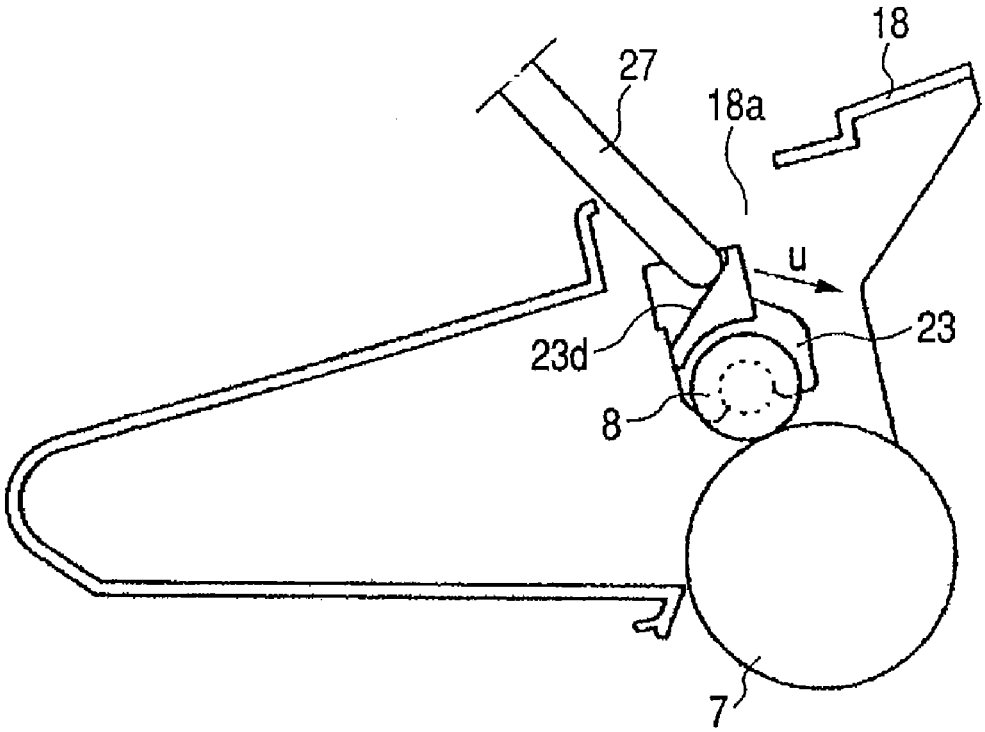
FIGS. 4A and 4B are illustrations in which the spacer is operated.
Figure 4B:
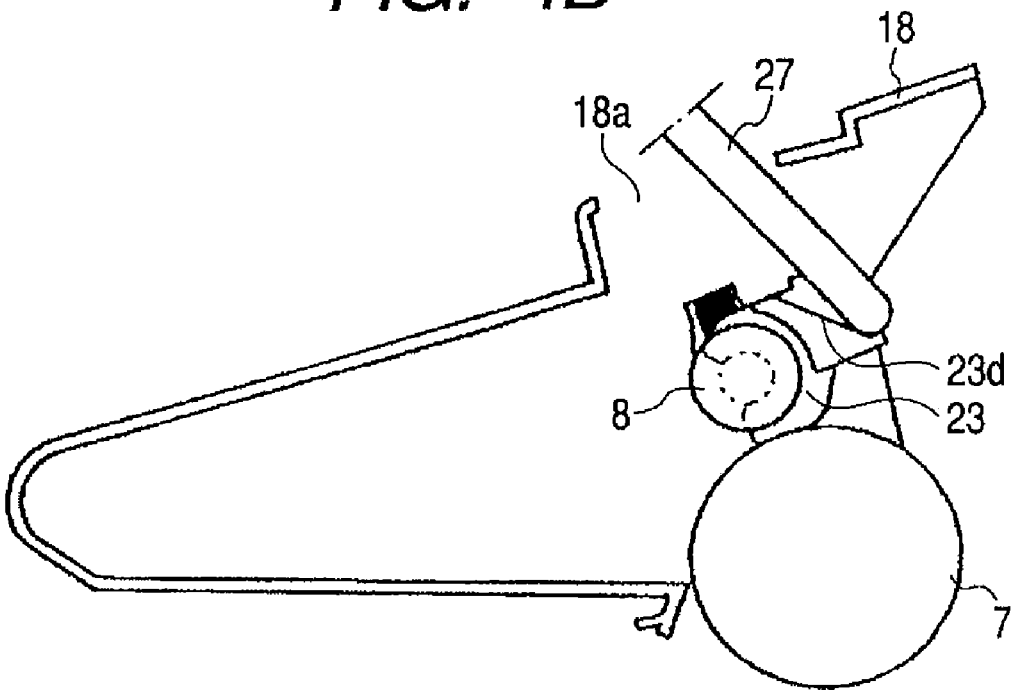

In the present embodiment, as shown in FIGS. 4A and 4B, an aperture 18*a* is formed in the upper surface of the drum frame 18, and an operating portion 23*d* is provided on the spacer 23. Thus, a tool 27 can be inserted through the aperture 18*a* and be rammed against the operating portion 23*d* of the spacer 23 (see also FIGS. 1A and 1B) to thereby push it in the direction indicated by the arrow "u". Therefore, even after assembly, the spacer 23 can be easily rotated and the charging roller 8 can be separated from the photosensitive drum 7.

Figure 5:
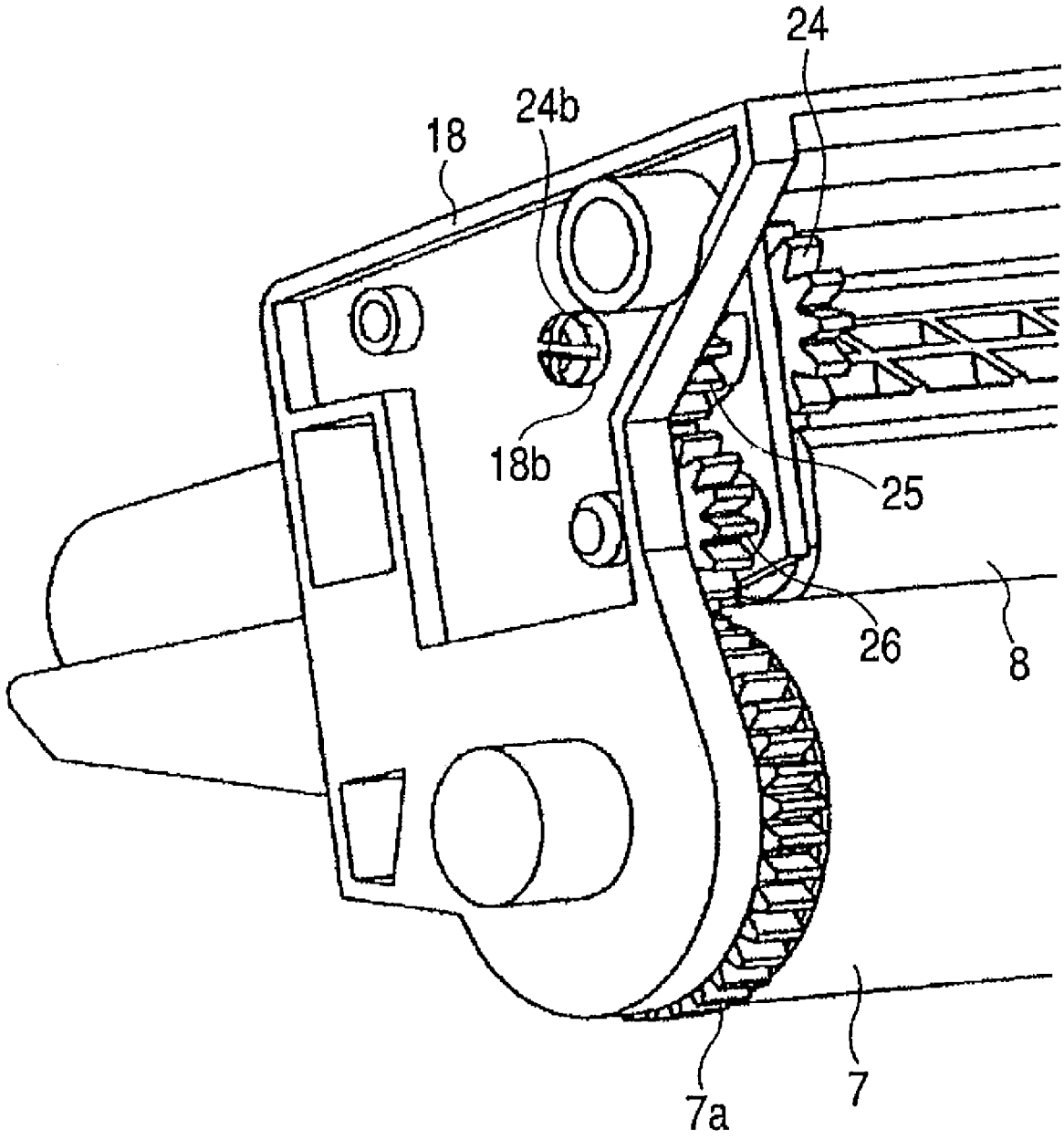
FIG. 5 is an illustration of a construction for rotating a spacer gear.

Also, as shown in FIG. 5, in the present embodiment, design is made such that the transmission gear 24 can be rotated from the exterior of the cartridge B (drum frame 18). That is, an aperture portion 18*b* is formed in the drum frame 18, and a cross-shaped groove as a restrained portion is formed in the tip end of the shaft portion 24*b*, and the tip end is exposed from the aperture portion 18*b*. Thereby, the transmission gear 24 can be rotated from the exterior of the cartridge B by the use of a jig such as a driver.

Also, by the utilization of the cross-shaped groove, a restraining member (not shown) having a cross-shaped protrusion as a restraining portion is mounted on the drum frame 18. Thereby, the rotation of the transmission gear 24 can also be regulated. That is, the cross-shaped protrusion is brought into engagement with the cross-shaped groove, and the restraining member is slidden and inserted into a slit (not shown) formed in the surface of the drum frame 18. Or the cross-shaped protrusion is brought into engagement with the cross-shaped groove, and the restraining member is stuck to the surface of the drum frame 18 by an adhesive double coated tape or the like and is fixed thereto. Thereby, the rotation of the transmission gear 24 when a shock is applied to the cartridge B can be prevented more reliably. Also, the restraining member may be attached to a toner seal. In this case, the operator can pull the toner seal to thereby release also the regulation of the rotation of the transmission gear 24.

[Prevention of the Reverse Rotation of the Spacer]

As described above, the cartridge B according to the present embodiment is such that during the shipment thereof, the charging roller 8 is separated from the photosensitive drum 7. In the present embodiment, design is made such that at this time, the spacer 23 is not rotated by vibration or the like. A construction therefore will now be described.

During the assembly of the cartridge B, the charging roller 8 and the spacer 23 are brought into the phase of FIG. 2B and the photosensitive drum 7 is assembled to the drum frame 18 from the direction indicated by the arrow "w". The photosensitive drum 7 first contacts with the arcuate portion 23*c* of the spacer 23, and the spacer 23 is raised, whereby the charging roller 8 is separated from the photosensitive drum 7. Also, at this time, the transmission gear 24 and the spacer gear 23*b* come into meshing engagement with each other.

The cartridge B assembled in this manner is shipped in the state of FIG. 2B. During the shipment, the cartridge B is subjected to various vibrations and shocks. At this time, the cleaning blade 17*a* abuts against the photosensitive drum 7 in a counter direction so that the tip end portion of the cleaning blade 17*a* may extend into the photosensitive drum 7 (see FIG. 10). By such abutment of the cleaning blade 17*a*, the force necessary to forwardly rotate (the direction indicated by the arrow "k" in FIG. 10) the photosensitive drum 7 becomes great, and the force necessary to reversely rotate (a direction opposite to the direction indicated by the arrow "k") becomes small. Consequently, during the shipment, the photosensitive drum 7 is liable to be reversely rotated (the direction opposite to the direction indicated by the arrow "k") by vibration or the like. In the present embodiment, the reverse rotation (a direction opposite to the direction indicated by the arrow "y") of the spacer 23 is regulated to thereby prevent the reverse rotation of the photosensitive drum 7.

Figure 6:
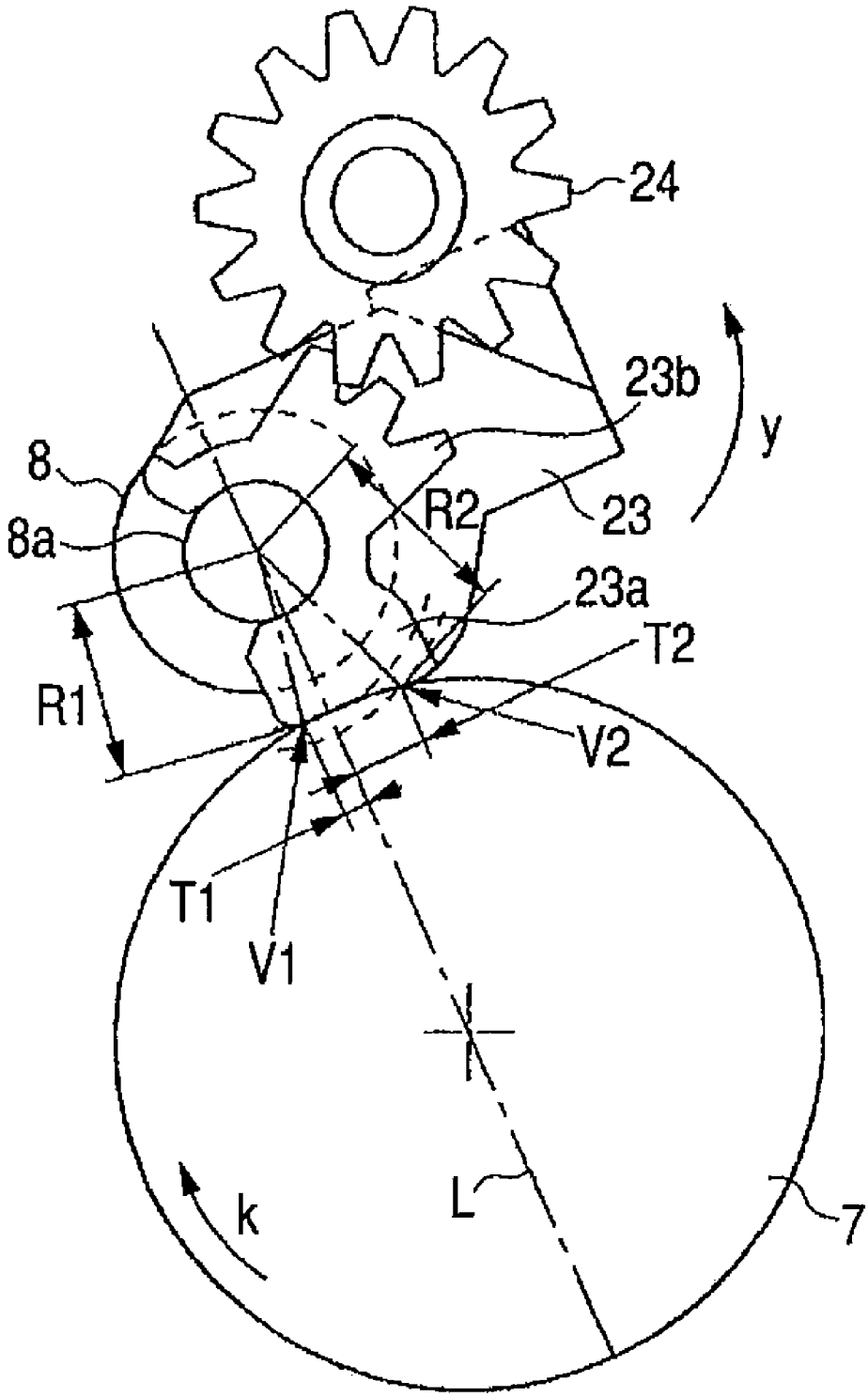
FIG. 6 is an illustration of a construction for preventing the reverse rotation of the spacer.

In the present embodiment, the shape of the arcuate portion 23*c* of the abutment portion of the spacer 23 against the photosensitive drum 7 is made into such a shape as shown in FIG. 6.

In the present embodiment, the diameter of the photosensitive drum 7 is 30 mm, the roller diameter of the charging roller 8 is 12 mm, the diameter of the roller shaft 8*a* thereof is 6 mm, the separation distance between the photosensitive drum 7 and the charging roller 8 is 1.5 mm, and the diameter of the arcuate portion 23*c* is equal to that of the photosensitive drum 7, i.e., 30 mm.

The arcuate portion 23*c* is of an asymmetrical shape about a center line L connecting the center of the rotary shaft of the charging roller 8 and the center of the rotary shaft of the photosensitive drum 7. Therefore, when the distance T1 between a point V1 on the forward rotation (rotation in the direction indicated by the arrow "k") side of the photosensitive drum 7 and the center line L is defined as T1, and the distance between a point V2 on the reverse rotation side and the center line L is defined as T2, T1 and T2 are set so as to be T1<T2. In the present embodiment, T1=1.1 mm, and T2=3.3 mm.

The smaller becomes the distances T1 and T2, the smaller becomes the rotating force necessary for the spacer 23 to be rotated, and conversely, the greater become the distances T1 and T2, the greater becomes the rotating force necessary for the spacer 23 to be rotated. This is because when the spacer 23 is rotated, the point V1 or V2 becomes the fulcrum of the rotation of the spacer 23 itself and must raise the metal shaft 8*a* of the charging roller urged by a spring 22, and also because depending on the difference between rotation radii R1 and R2, a greater raising stroke amount leads to a greater amount by which the spring 22 is compressed, and a greater repulsive force.

As previously described, during shipment or the like, the photosensitive drum 7 is not forwardly rotated (the direction indicated by the arrow "k") by the abutment of the cleaning blade 17*a*, but yet there is the possibility of the spacer 23 itself being rotated in the direction indicated by the arrow "y" due to the shock or the like during the shipment. Therefore, the distance T1 is set so that the spacer 23 may not be rotated by that degree of shock and that the spacer 23 can be rotated the driving of the main body at the start of image formation. That is suitably determined by the weight, the package state, etc. of the entire cartridge B, and is not restricted to the aforementioned value.

Figure 7:
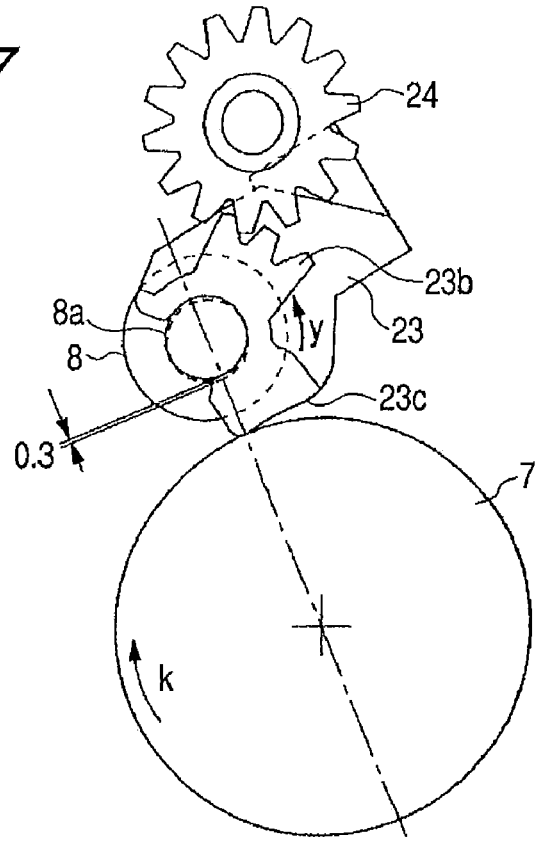
FIG. 7 is an illustration of a state in which a transfer roller is separated from a photosensitive member.

In the present embodiment, in the case of the forward rotation of the photosensitive drum 7, the stroke amount is set so that the metal shaft 8*a* of the charging roller 8 may be further raised by the order of 0.3 mm from the separated state (see FIG. 7). In the case of this degree, the separation can be reliably released by the driving of the main body. On the other hand, the distance T2 is set to a value greater than T1 and therefore, even when the photosensitive drum 7 is about to be reversely rotated by the shock or the like during the shipment, the raising stroke amount of the metal shaft 8*a* is as great as 1 mm, and the metal shaft cannot be raised by a small force. Therefore, the reverse rotation (a direction opposite to the direction indicated by the arrow "y" in FIG. 7) of the spacer 23 can be restricted to thereby prevent the reverse rotation of the photosensitive drum 7.

Figure 8:
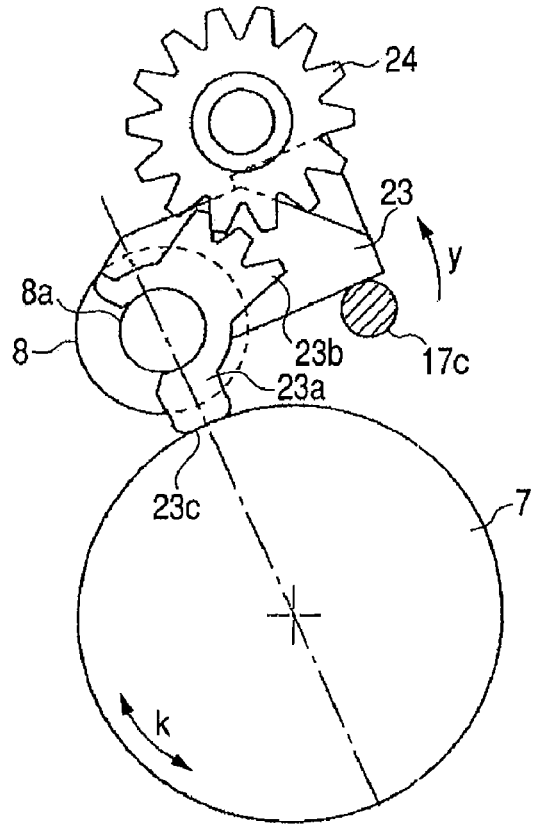
FIG. 8 is an illustration showing another example of the construction for preventing the reverse rotation of the spacer.

The aforedescribed construction is not restrictive, but design may be made such that as shown in FIG. 8, provision is made of a regulating portion 17*c* which does not abut against the spacer 23 when the spacer 23 is forwardly rotated (the direction indicated by the arrow "y"), but abuts against the spacer 23 when the spacer 23 is about to be reversely rotated, whereby the movement of the spacer 23 is regulated.

Also, design may be made of such that space in which the metal shaft 8*a* of the charging roller 8 can be raised is larger than an amount necessary when the spacer 23 is forwardly rotated, and smaller than an amount necessary when the spacer 23 is reversely rotated. By doing so, the spacer 23 cannot be reversely rotated if the metal shaft 8*a* and the bearings 21 are adapted to be interfered with the support frame of these when they are moved. Thereby, it becomes possible to prevent the reverse rotation of the photosensitive drum 7.

Other Embodiments

Another embodiment of the aforedescribed drive transmission to the spacer 23 will now be described with reference to the drawings. The basic construction for an apparatus according to this embodiment and therefore, duplicate description will be omitted and only the portions thereof different from those of the first embodiment will be described. Also, members functionally similar to those in the aforedescribed embodiment are given the same reference.

Figure 14:
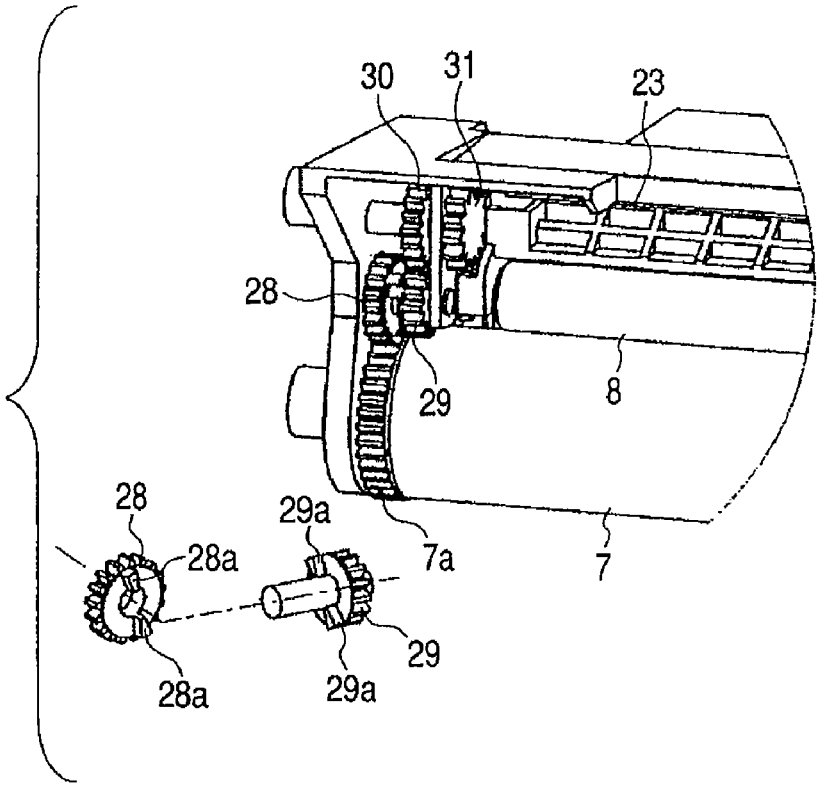
FIG. 14 is an illustration of an embodiment in which a coupling portion is provided on the way to a gear train for transmitting a driving force to the spacer.

FIG. 14 shows an embodiment in which coupling portions are provided in the course of a gear train for transmitting a driving force to the spacer 23. In this embodiment, there is adopted a construction in which the drive is transmitted from the drum gear 7*a* of the photosensitive drum 7 to gears 28, 29, 30 and 31 to thereby move the spacer 23. Coupling portions 28*a* and 29*a* are formed on the gear 28 and gear 29, respectively, in the course of drive transmission so as to have a range within which they can be freely rotated relative to each other, as in the aforedescribed first embodiment. Again in such a construction wherein the coupling portions are provided in the course of the gear train, there can be obtained an effect similar to that of the first embodiment.

Figure 15:
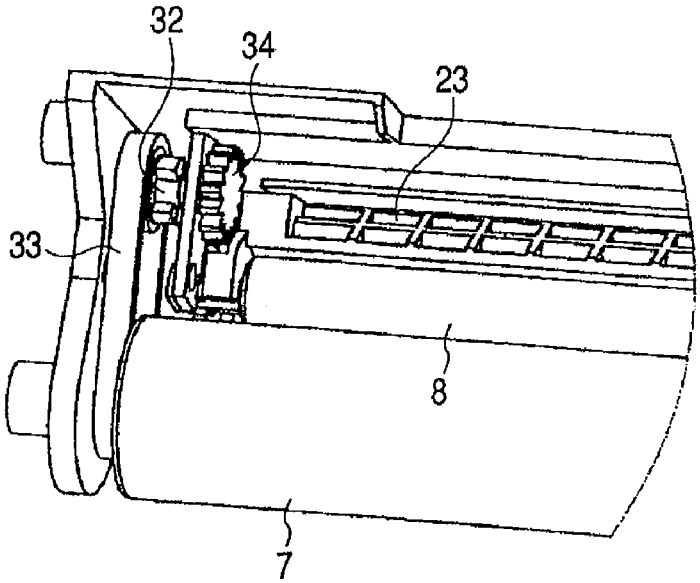
FIG. 15 is an illustration of an embodiment using a belt for the drive transmission to the spacer.

FIG. 15 shows an embodiment using a belt for the drive transmission to the spacer 23. In the aforedescribed first embodiment, a gear is used for the drive transmission from the photosensitive drum 7 to the spacer 23. In contrast, in the present embodiment, as shown in FIG. 15, a belt 33 is used for the drive transmission from the photosensitive drum 7 to a pulley 32. A coupling portion is provided between the pulley 32 and a gear 34 for transmitting the driving force to the spacer 23 so as to have a range within which they can be freely rotated relative to each other, as in the first embodiment. Again in such a construction, there can be obtained an effect similar to that of the first embodiment.

According to the above-described embodiment, the separated state can be reliably released during the first use of the process cartridge or the image forming apparatus. Further, a driving force which reversely rotates the electrophotographic photosensitive member is not produced when the charging roller is separated from the electrophotographic photosensitive member. Therefore, the load which moves the separation member is small and the operation can be made easy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-115169, filed Apr. 19, 2006, which is hereby incorporated by reference herein in its entirety.

What is claimed is:

1. A process cartridge detachably mountable to a main body of an electrophotographic image forming apparatus for forming an image on a recording medium, said process cartridge comprising:

a rotatable electrophotographic photosensitive member;

a charging roller for contacting said electrophotographic photosensitive member to charge said electrophotographic photosensitive member;

a separation member for separating said electrophotographic photosensitive member and said charging roller from each other, and movable between a separation position for separating said electrophotographic photosensitive member and said charging roller from each other: and a contact position for bringing said electrophotographic photosensitive member and said charging roller into contact with each other;

a rotatable driving force receiving member for receiving a driving force produced by said electrophotographic photosensitive member being rotated; and a rotatable driving force transmission member for being engaged with said driving force receiving member to transmit the driving force from said driving force receiving member to said separation member, in order to move said separation member from the separation position to the contact position, wherein play is provided in an engagement portion between said driving force receiving member and said driving force transmission member so that said driving force receiving member and said driving force transmission member can be freely rotated relative to each other by a predetermined angle so as to prevent said driving force receiving member from rotating when said separation member is moved from the contact position to the separation position.

2. A process cartridge according to claim 1, wherein said electrophotographic photosensitive member is rotated in the same direction as a direction in which said electrophotographic photosensitive member is rotated when an image is formed, and thereafter said driving force transmission member is rotated in the same direction as a direction in which said driving force transmission member is rotated when the image is formed, and thereafter said separation member is moved from said contact position to said separation position.

3. A process cartridge according to claim 1, wherein said driving force receiving member has a first protrusion, said driving force transmission member has a second protrusion, and said first protrusion and said second protrusion contact with each other so that the driving force is transmitted from said driving force receiving member to said driving force transmission member.

4. A process cartridge according to claim 1, wherein said separation member is pivotably provided on a shaft portion of said charging roller at opposite ends of said charging roller.

5. A process cartridge according to claim 1, wherein said separation member and said driving force transmission member are designed not to be engaged with each other when said separation member is located in the contact position.

6. A process cartridge according to claim 1, wherein the predetermined angle is greater than a rotation angle of said driving force transmission member when said separation member is moved from the contact position to the separation position.

7. A process cartridge according to claim 1, wherein said separation member is provided with an operating portion operable from outside said process cartridge, and said operating portion is urged from outside to move said separation member from the contact position to the separation position.

8. An electrophotographic image forming apparatus comprising:

a process cartridge as recited in claim 1; and a main body of said electrophotographic image forming apparatus.

9. A process cartridge detachably mountable to a main body of an electrophotographic image forming apparatus for forming an image on a recording medium, said process cartridge comprising:

a rotatable electrophotographic photosensitive member;

a charging roller for contacting said electrophotographic photosensitive member to charge said electrophotographic photosensitive member;

a separation member for separating said electrophotographic photosensitive member and said charging roller from each other, and movable between a separation position for separating said electrophotographic photosensitive member and said charging roller from each other, and a contact position for bringing said electrophotographic photosensitive member and said charging roller into contact with each other;

a rotatable driving force receiving member for receiving a driving force produced by said electrophotographic photosensitive member being rotated in the same direction as a direction in which said electrophotographic photosensitive member is rotated when an image is formed, in order to move said separation member from the separation position to the contact position; and a rotatable driving force transmission member for being engaged with said driving force receiving member to transmit the driving force from said driving force receiving member to said separation member in order to move said separation member from the separation position to the contact position, wherein play is provided in an engagement portion between said driving force receiving member and said driving force transmission member so that said driving force receiving member and said driving force transmission member can be freely rotated relative to each other by a predetermined angle so as to prevent said driving force receiving member from rotating when said separation member is moved from the contact position to the separation position, and said electrophotographic photosensitive member is rotated in the same direction as a direction in which said electrophotographic photosensitive member is rotated when an image is formed, and thereafter said driving force transmission member is rotated in the same direction as a direction in which said driving force transmission member is rotated when the image is formed, and thereafter said separation member is moved from the contact position to the separation position.

10. A method of manufacturing a process cartridge detachably mountable to a main body of an electrophotographic image forming apparatus for forming an image on a recording medium, the process cartridge having a rotatable electrophotographic photosensitive member, a charging roller for charging the electrophotographic photosensitive member, a separation member movable between a separation position for separating the electrophotographic photosensitive member and the charging roller from each other, and a contact position for bringing the electrophotographic photosensitive member and the charging roller into contact with each other, a rotatable driving force receiving member for receiving a driving force produced by the electrophotographic photosensitive member being rotated in the same direction as a direction in which the electrophotographic photosensitive member is rotated when an image is formed, and a rotatable driving force transmission member engaged with the driving force receiving member to transmit the driving force from the driving force receiving member to the separation member, wherein play is provided in an engagement portion between the driving force receiving member and the driving force transmission member so that the driving force receiving member and the driving force transmission member can be freely rotated relative to each other by a predetermined angle so as to prevent said driving force receiving member from rotating when said separation member is moved from the contact position to the separation position, said method comprising:

a photosensitive member rotating step of rotating the electrophotographic photosensitive member in the same direction as the direction in which the electrophotographic photosensitive member is rotated when the image is formed;

a transmission member rotating step of rotating the driving force transmission member in the same direction as a direction in which the driving force transmission member is rotated when the image is formed, after said photosensitive member rotating step; and a separation member moving step of moving the separation member from the contact position to the separation position after said transmission member rotating step.

11. A method of remanufacturing a process cartridge detachably mountable to a main body of an electrophotographic image forming apparatus for forming an image on a recording medium, said process cartridge having a rotatable electrophotographic photosensitive member, a charging roller for charging said electrophotographic photosensitive member, a separation member movable between a separation position for separating the electrophotographic photosensitive member and the charging roller from each other, and a contact position for bringing the electrophotographic photosensitive member and the charging roller into contact with each other, a rotatable driving force receiving member for receiving a driving force produced by the electrophotographic photosensitive member being rotated in the same direction as a direction in which the electrophotographic photosensitive member is rotated when an image is formed, and a rotatable driving force transmission member engaged with the driving force receiving member to transmit the driving force from the driving force receiving member to the separation member, wherein play is provided in an engagement portion between the driving force receiving member and the driving force transmission member so that the driving force receiving member and the driving force transmission member can be freely rotated relative to each other by a predetermined angle so as to prevent said driving force receiving member from rotating when said separation member is moved from the contact position to the separation position, said method comprising:

a photosensitive member interchanging step of detaching the electrophotographic photosensitive member, and thereafter mounting another electrophotographic photosensitive member differing from the detached electrophotographic photosensitive member;

a photosensitive member rotating step of rotating the another electrophotographic photosensitive member in the same direction as the direction in which the another electrophotographic photosensitive member is rotated when the image is formed, after said photosensitive member interchanging step;

a transmission member rotating step of rotating the driving force transmission member in the same direction as a direction in which the driving force transmission member is rotated when the image is formed, after said photosensitive member rotating step; and a separation member moving step of moving the separation member from the contact position to the separation position after said transmission member rotating step.

* * * * *